US007144230B2

(12) United States Patent
Nonaka

(10) Patent No.: US 7,144,230 B2
(45) Date of Patent: Dec. 5, 2006

(54) PULSE FUEL PUMP FOR A DIAPHRAGM CARBURETOR

(75) Inventor: Takumi Nonaka, Iwate-ken (JP)

(73) Assignee: Zama Japan (JP)

( * ) Notice: Subject to any disclaimer, the term of this patent is extended or adjusted under 35 U.S.C. 154(b) by 483 days.

(21) Appl. No.: 10/637,303

(22) Filed: Aug. 7, 2003

(65) Prior Publication Data

US 2005/0031473 A1 Feb. 10, 2005

(51) Int. Cl.
*F04B 23/00* (2006.01)
*F04B 49/00* (2006.01)

(52) U.S. Cl. ..... 417/441; 417/307

(58) Field of Classification Search ..... 417/540, 417/441, 440, 307; 261/35, 69.1, DIG. 68
See application file for complete search history.

(56) References Cited

U.S. PATENT DOCUMENTS 2,405,466 A * 8/1946 Tabb ..... 417/307
4,271,093 A * 6/1981 Kobayashi ..... 261/34.1
6,595,500 B1 * 7/2003 Osburg et al. ..... 261/34.2

* cited by examiner

*Primary Examiner*—Anthony D. Stashick
*Assistant Examiner*—Vikansha Dwivedi
(74) *Attorney, Agent, or Firm*—Orrick, Herrington & Sutcliffe LLP

(57) ABSTRACT

A device that corrects with ease and high precision any deviation of the fuel flow rate due to variation in the constituent components of a carburetor, and to improve the exhaust condition and operability of an engine. A carburetor in which the delivery channel 23 and the suction channel 20 of a fuel pump 15 are connected with the aid of an escape channel 27, and in which a portion of the delivery fuel is allowed to escape to the suction side in order to prevent pressure exerted on the fuel valve 10 by the fuel delivered to the constant fuel chamber 5 from the fuel pump 15, which operates by pressure pulses, from reaching or exceeding a specified level, wherein the escape channel 27 is equipped with a manual control valve 29 for steplessly adjusting the surface area thereof. The quantity of fuel retained in the constant fuel chamber 5 can be adjusted so as to achieve a predetermined fuel flow rate by changing the escape quantity of the delivery fuel and rendering the fuel valve 10 more resistant to opening or less resistant to opening.

5 Claims, 2 Drawing Sheets

[Figure 1]
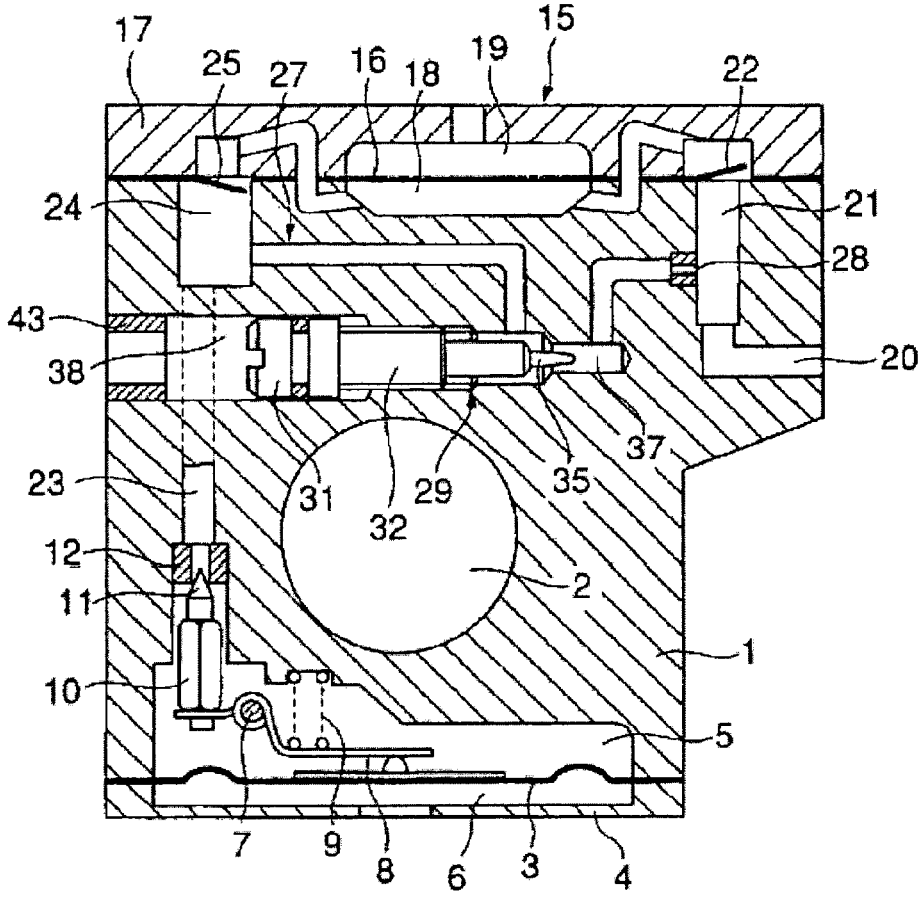
[Figure 2]
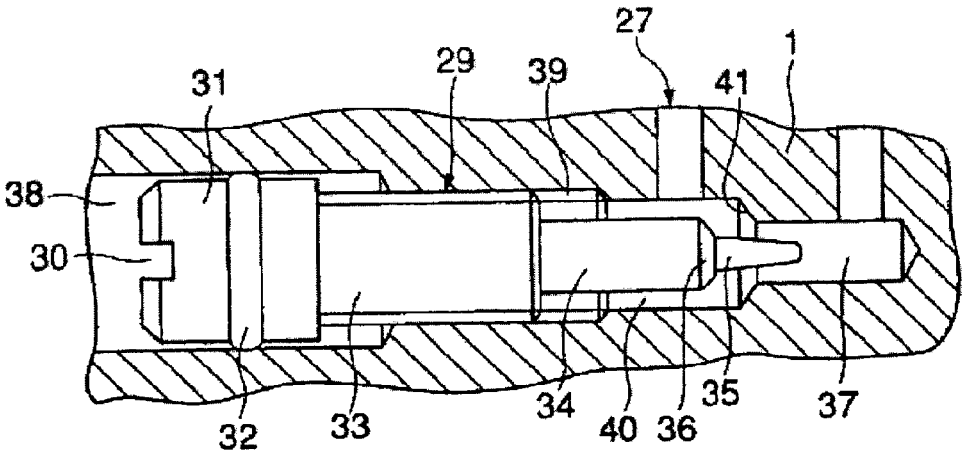

[Figure 3]
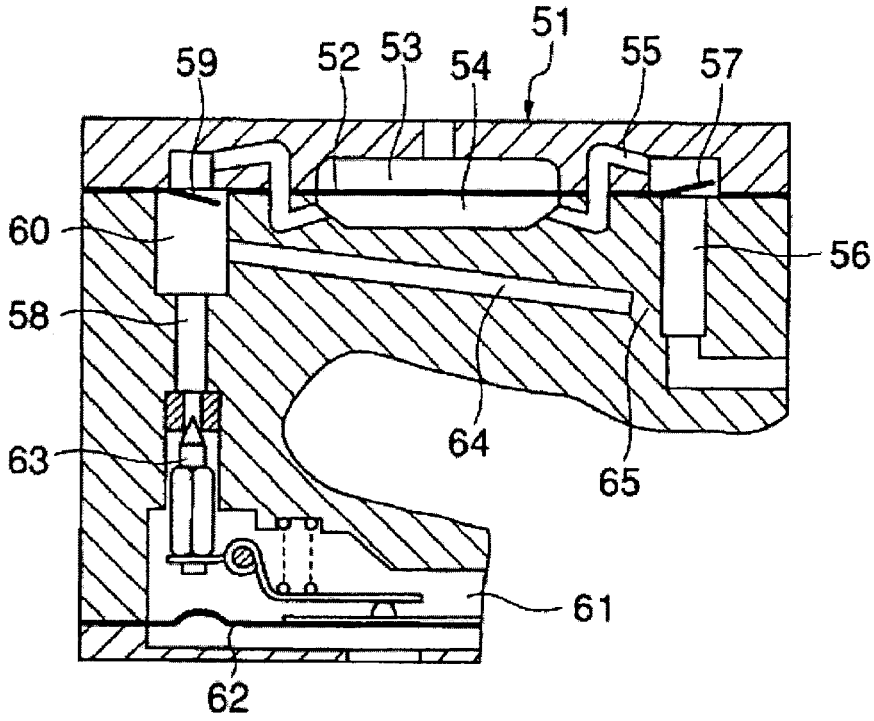
[Figure 4]
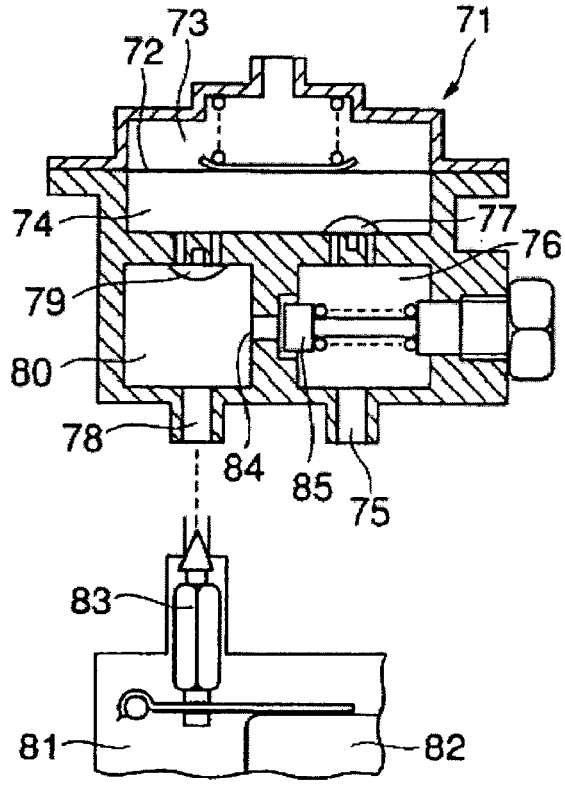

PULSE FUEL PUMP FOR A DIAPHRAGM CARBURETOR

FIELD OF THE INVENTION

The present invention relates to pulse-type diaphragm fuel pump for suppying fuel from a fuel tank to a diaphragm-type or float-type constant fuel chamber of a carburetor.

There are pulse-type diaphragm fuel pumps in which the diaphragm performs reciprocating displacement motion by pressure pulses generated in the suction manifold or the crankcase in association with the rotation of the engine, commonly by pressure pulses generated in the crankcase, which operate to suction fuel from the fuel tank into the pump chamber at negative pressure, and to deliver fuel from the pump chamber toward the constant fuel chamber of a carburetor at positive pressure. These pumps are widely used as means to supply fuel to the carburetor, which supplies fuel to general-purpose engines.

The fuel valve, which allows or stops the flow of fuel delivered from the fuel pump into the constant fuel chamber, opens and closes so as to retain a fixed quantity of fuel in the constant fuel chamber in accordance with the up and down movement of the float or the reciprocating displacement motion of the diaphragm. The pressure pulses generated by the crankcase or other means in association with the rotation of the engine are repetitions of negative pressure and positive pressure, and the mean pressure thereof increases in association with an increase in the rotational speed of the engine and is at its greatest at full speed.

In a range of high speed rotation, drawbacks are demonstrated in that the delivery fuel pressure becomes greater than the specified pressure that works on the fuel valve. As a result, the valve is forcefully opened, fuel from the constant fuel chamber is supplied in excess, and the air-fuel mixture is made rich, causing output to be lost and exhaust conditions to be worsened. To address this drawback, the delivery fuel pressure is adjusted to remain equal to or less than a specified pressure for the fuel valve by allowing a portion of the delivery fuel to escape to a low pressure region on the suction side.

FIGS. 3 and 4 are diagrams that show conventionally known delivery fuel pressure adjustment means. FIG. 3 is a variation in which a diaphragm-type carburetor and a pulse-type diaphragm fuel pump are integrally configured. FIG. 4 is a variation in which a float-type carburetor and a pulse-type diaphragm fuel pump are separately configured.

First, with reference to FIG. 3, fuel pump 51 comprises a pulse chamber 53 and a pump chamber 54 facing each other across a diaphragm 52; a suction channel 55 having a suction chamber 56 and a suction valve 57, for introducing fuel from a fuel tank into the pump chamber 54; and a delivery channel 58 having a delivery valve 59 and a delivery chamber 60, for guiding fuel pressurized in the pump chamber 54 to a constant fuel chamber 61. The exit portion to the constant fuel chamber 61 of the delivery channel 58 is opened and closed by a fuel valve 63 that operates in accordance with the reciprocating displacement motion of the diaphragm 62.

The delivery chamber 60 formed on the exit side of the delivery valve 59, and the suction chamber 56 formed on the entrance side of the suction valve 57 are connected by way of an escape channel 64 having a throttle 65 for limiting the fuel escape quantity.

The escape channel 64 constantly links the suction side and the delivery side of the fuel pump 51. This delivery fuel pressure adjustment means is therefore configured so that the fuel escape quantity is increased by the difference in pressure between the delivery side and the suction side when there is an increase in the delivery fuel pressure. As a result, a pressure equal to or greater than a specified pressure is prevented from being exerted on the fuel valve 63.

Second, with reference to FIG. 4, fuel pump 71 comprises a pulse chamber 73 and a pump chamber 74 facing each other across a diaphragm 72; a suction channel 75 having a suction chamber 76 and a suction valve 77, for introducing fuel from a fuel tank into the pump chamber 74; and a delivery channel 78 having a delivery valve 79 and a delivery chamber 80, for guiding fuel pressurized in the pump chamber 74 to a constant fuel chamber 81. The exit portion to the constant fuel chamber 81 of the delivery channel 78 is opened and closed by a fuel valve 83 that operates in accordance with the up and down movement of a float 82.

The delivery chamber 80 formed on the exit side of the delivery valve 79, and the suction chamber 76 formed on the entrance side of the suction valve 77 are connected by way of an escape channel 84, and a piston-type escape valve 85 for opening and closing the escape channel 84 is provided.

The escape valve 85 in the delivery fuel pressure adjustment means that comprises the escape channel 84 and escape valve 85 is opened by pressure when the delivery fuel pressure becomes equal to or greater than a set value. As a result, a pressure equal to or greater than a specified amount is prevented from being exerted on the fuel valve 83 by opening the escape channel 84 and allowing a portion of the delivery fuel to escape to the suction side.

In common practice, there are variations in all components of a carburetor that cannot be avoided in the production process. In particular, variations in the components related to the fuel flow rate and disposed in the fuel passage that reaches the suction channel from the constant fuel chamber varies the fuel flow rate supplied to the engine and directly affects the exhaust condition. It is well known that precise control of the fuel flow rate is required in order to meet emission regulations, and more-precise control is particularly required for carburetors that handle a small quantity of fuel, such as carburetors for general-purpose engines.

Nevertheless, in the conventional delivery fuel pressure adjusting means described above, the fuel level of the constant fuel chambers 61 and 81 is held constant by limiting the fuel pressure exerted on the fuel valves 63 and 83 to a pressure equal to or less than that set in advance by the valve-closing spring load of the escape valve 85 or the diameter of the throttle 65. As a result, variability in the fuel flow rate created by variation in the constituent components of the fuel passage, which reaches the suction channel from the constant fuel chambers 61 and 81, cannot be corrected, and it is impossible to precisely control the fuel flow rate so as to meet emission regulations.

SUMMARY OF THE INVENTION

The present invention provides a solution to the above-described drawbacks in a conventional delivery fuel pressure adjusting means composed of a throttle or a throttle valve in the escape channel in which variability in the fuel flow rate due to variation in the constituent components of the carburetor cannot be corrected to meet emission regulations. An object thereof is to provide a pulse-type diaphragm fuel pump comprising a delivery fuel pressure adjusting means that is capable of arbitrarily adjusting the delivery fuel pressure exerted on the fuel valve so as to solve the variability of the fuel flow rate created by variation in the constituent components of the carburetor, making it possible to set the fuel flow rate supplied to the engine to an accurate flow that meets emission regulations, and hence to allow the engine to operate in a stable manner.

The present invention provides a solution to such problems by providing a pulse-type diaphragm fuel pump for a carburetor comprising a pulse chamber and a pump chamber facing each other across a diaphragm, a suction channel having a suction valve for introducing fuel from a fuel tank into the pump chamber, and a delivery channel having a delivery valve, for guiding fuel pressurized in the pump chamber to a constant fuel chamber in the carburetor; wherein the exit side of the delivery valve of the delivery channel and the entrance side of the suction valve of the suction channel are connected by an escape channel for allowing a portion of the delivery fuel to escape to the suction side, wherein a manual control valve for steplessly adjusting the escape surface area of the escape channel is provided. Alternatively, a throttle for limiting the fuel escape quantity to an amount less than the maximum throughflow of the control valve to the return channel is additionally provided to such a control valve.

When the fuel flow rate changes to one that is less than a predetermined quantity due to the variation in constituent components of carburetors, the quantity of fuel retained in the constant fuel chamber can be increased and the fuel flow rate to the suction channel enhanced by decreasing the degree of opening of the control valve to reduce the fuel escape quantity, increase the pressure exerted on the fuel valve, and facilitate opening. When the fuel flow rate conversely changes to one that is greater than a predetermined quantity, the quantity of fuel retained in the constant fuel chamber can be decreased and the fuel flow rate to the suction channel enhanced by increasing the degree of opening of the control valve to increase the fuel escape quantity, reduce the pressure exerted on the fuel valve, and impede opening.

In other words, by adjusting the degree of opening of the control valve, the delivery fuel pressure exerted on the fuel valve can be steplessly changed, variability of the fuel flow rate due to variation in the constituent components of a carburetor can be corrected, and a predetermined flow rate of fuel can be accurately supplied, with the result that the objective of meeting emission regulations and consequently making the operability of the engine stable can be achieved.

In a carburetor wherein a throttle, in addition to a control valve, is provided to the escape channel, the delivery fuel pressure exerted on the fuel valve does not reach or fall below a fixed value even if the control valve is completely opened, and the minimum fuel flow rate required by the engine can be held to a range which allows the objectives of the present invention to be achieved.

BRIEF DESCRIPTION OF THE DRAWINGS

FIG. 1 is a longitudinal section showing an embodiment of the present invention.

FIG. 2 is an enlarged view of the principal components of FIG. 1.

FIG. 3 is a schematic longitudinal section showing a conventional embodiment.

FIG. 4 is a schematic longitudinal section showing another conventional embodiment.

DETAILED DESCRIPTION OF THE PREFERRED EMBODIMENT

FIGS. 1 and 2 show an embodiment in which the present invention is integrally incorporated into a diaphragm-type carburetor. A diaphragm 3 and a diaphragm cover 4 are overlaid on the lower surface of a main body 1. A suction channel 2 having a venturi tube and throttle valve is laterally formed completely through the main body 1. The internal space of a diaphragm cover 4 and the cavity of the main body 1 facing each other across a diaphragm 3 form a constant fuel chamber 5 and a back pressure chamber 6 connected to the atmosphere.

A lever 8 supported in a freely rotatable manner by a pin 7 is mounted inside the constant fuel chamber 5. One end of this lever 8 is held in constant contact with the center portion of the diaphragm 3 by a spring 9, and the fuel valve 10 is attached to the other end. The valve element 11 of the fuel valve 10 is needle-shaped or conically shaped, and is seated in a valve seat 12, which is disposed on the exit end of the constant fuel chamber 5 of the delivery channel 23 of the fuel pump 15 described hereinafter, by a valve closing force exerted by the spring 9.

When the quantity of fuel retained in the constant fuel chamber 5 decreases, the diaphragm 3 displaces in the direction of the constant fuel chamber 5 and pushes the lever 8 upward to cause rotation, the valve element 11 separates from the valve seat 12, and fuel delivered by the fuel pump 15 is introduced to the constant fuel chamber 5. When the quantity of fuel retained increases and the diaphragm 3 displaces toward the back pressure chamber 6, the spring 9 pushes the lever 8 to cause rotation, the valve element 11 is seated in the valve seat 12, and the delivery channel 23 is closed.

The diaphragm 16 and the pump cover 17 are overlaid on the upper surface, which is on the opposite side of the constant fuel chamber 5 of the main body 1. The internal space of the pump cover 17 and the cavity of the main body 1 face each other across a diaphragm 16 forming a pump chamber 18 and pulse chamber 19 connected to the crankcase. A suction channel 20 and a delivery channel 23 are connected to the pump chamber 18. The diaphragm 16, pump chamber 18, pulse chamber 19, suction channel 20, and delivery channel 23 constitute the fuel pump 15.

The suction channel 20 has a suction chamber 21 opened on the upper surface of the main body 1, as well as a flap-shaped suction valve 22 formed by providing an incision in the diaphragm 16 that covers the upper surface of the opening thereof, and an entrance end connected to the fuel tank. The delivery channel 23 has a delivery chamber 24 opened on the upper surface of the main body 1, as well as a flap-shaped delivery valve 25 formed by providing an incision in the diaphragm 16 that covers the upper surface where the valve opens, and the above-described valve seat 12 is disposed at the exit end. The suction chamber 21 and the delivery chamber 24 smooth the pulse of the fuel and aid in increasing the suction and delivery efficiency, but are not necessarily required.

When the pressure pulse created in the crankcase in association with the rotation of the engine is introduced into the pulse chamber 19, the diaphragm 16 when under negative pressure displaces in the direction of the pulse chamber 19, the pump chamber 18 is placed under negative pressure, the suction valve 22 opens, the fuel sent to the suction channel 20 from the fuel tank is introduced to the pump chamber 18, the delivery valve 25 closes, and the delivery channel 23 is closed. When the pressure pulse introduced into the pulse chamber 19 is positive, the diaphragm 16 displaces in the direction of the pump chamber 18, the pump chamber 18 is placed under negative pressure, the delivery valve 25 opens, the fuel pressurized in the pump chamber 18 is introduced to the constant fuel chamber 5 from the delivery channel 23, the suction valve 22 closes, and the suction channel 20 is closed. Supplying fuel from the fuel tank to the constant fuel chamber 5 with this action is the same as a conventional pulse-type diaphragm fuel pump.

The delivery chamber 24 positioned at the exit side of the delivery valve 25 of the delivery channel 23, and the suction chamber 21 positioned at the entrance side of the suction valve 22 of the suction channel 20 are connected by way of an escape channel 27 formed in the main body 1. The escape channel 27 is configured so that the channel surface area is steplessly adjustable by a control valve 29 disposed partway, and has a throttle 28 comprising a fixed jet on the downstream side thereof.

The control valve 29 comprises a needle-shaped valve element 35 that protrudes at the leading end of a valve stem 34, itself extending forward from the leading end of a screw shaft 33 in which a head body 31 with a tool hole 30 has been provided to the base end, and also comprises a valve hole 37 formed in the escape channel 27. The valve element 35 is fashioned so as to be capable of being inserted and removed from the valve hole 37 by positioning the valve hole 37 on the same center axis line, inserting a screw shaft 33 into an attachment hole 38 having a female screw 39 formed in the main body 1, and threadably fitting the female screw 39.

The region that reaches to the entrance of the valve hole 37 from the leading end portion of the female screw 39, which is the deep end portion of the attachment hole 38, forms a valve chamber 40. The escape channel 27 reaches the suction chamber 21 by way of the valve chamber 40 and valve hole 37 from the delivery chamber 24. The shoulder portion, which constitutes a transition from the valve stem 34 to the valve element 35, forms a conical contact surface 36, and the step portion that constitutes a transition from the valve chamber 40 to the valve hole 37 is a conical seat surface 41 fashioned at the same angle as the contact surface 36. A seal member 32 comprising an O-ring is mounted on the head body 31. The seal member 32 adheres to the peripheral surface of the attachment hole 38 and renders the valve chamber 40 air- and fluid-tight while simultaneously working as a detent for the screw shaft 33 by means of the friction force thereof.

The annular piece 43 is fixed by being press-fitted into an opening portion on the base end of the attachment hole 38. This annular piece 43 catches on the head body 31 and works to prevent the screw shaft 33 from escaping to the exterior of the main body 1 from the attachment hole 38 when the screw shaft 33 completely slips out from the female screw 39 and is in a free state inside the attachment hole 38. The annular piece 43 is fixedly fitted in the attachment hole 38 after the screw shaft 33 is turned and the insertion depth in the valve hole 37 of the valve element 35 is adjusted so as to configure the effective surface area of the escape channel 27 to the required surface area. It is, however, possible to insert a tool with a diameter smaller than the inside diameter thereof, to engage to the tool hole 30, and to make readjustments.

The fuel system that sends fuel from the constant fuel chamber 5 to the suction channel 2 comprises a main jet, a low-speed jet, a main bleed air jet, a low-speed bleed air jet, a main fuel control needle valve, a low-speed fuel control needle valve, a check valve for preventing back bleed, and a number of other functional components related to the fuel flow rate, and any variation that cannot be avoided in the production of the these components has a noticeable effect on the exhaust condition and engine operability, particularly in a carburetor for a general-purpose engine with a low fuel flow rate.

On the other hand, the mean pressure of a pressure pulse, which is a repetition of negative pressure and positive pressure introduced to the pulse chamber 19 of the fuel pump 15, increases as the rotational speed of the engine increases from a low speed to a high speed, and is maximum at full speed. A resulting drawback is that the delivery fuel pressure of the fuel pump 15 also increases in association with the rise in the rotational speed of the engine, and, as a result, the force in the direction of opening the valve exerted on the valve element 11 of the fuel valve 10 increases to forcibly open the valve, the fuel from the constant fuel chamber 5 is increased to a specified quantity or more, the fuel delivery rate to the suction channel 2 is increased, and the air-fuel mixture is made excessively rich.

This drawback is not consistent, and the fuel flow rate may change to become smaller or greater than the standard predetermined flow rate due to variation in the components of the fuel system that extends to the suction channel 2 from the constant fuel chamber 5. In view of the above, it is apparent that the variation in the fuel flow rate can be corrected by increasing the quantity of fuel retained in the constant fuel chamber 5 and raising the fuel flow rate in a fuel system whose fuel flow rate tends to decrease, and reducing the quantity of fuel retained in the constant fuel chamber 5 and lowering the fuel flow rate in a fuel system whose fuel flow rate tends to increase. Constantly delivering a predetermined flow rate of fuel to the suction channel 2 is preferable from the aspect of exhaust management and engine operating performance.

According to the present embodiment, the channel surface area of the escape channel 27 can be steplessly adjusted from a state wherein the valve element 35 is completely removed from the valve hole 37 and the control valve 29 is completely open, to a state wherein the contact surface 36 is seated in the seat surface 41 and wherein the valve is completely closed. The valve is completely closed by way of a state wherein the screw shaft 33 is rotated and advanced by manually operating a tool, the valve body 35 is inserted in the valve hole 37, and the effective surface area of the valve hole 37 is gradually reduced, and then a state wherein the contact surface 36 approaches the seat surface 41, and the interval between these gradually grows smaller.

For a fuel system in which the fuel flow rate delivered to the suction channel 2 from the constant fuel chamber 5 tends to become smaller than a standard predetermined flow rate, the insertion depth in the valve hole 37 of the valve element 35 is therefore increased, the fuel escape quantity which flows from the delivery chamber 24 toward the suction chamber 21 through the escape channel 27 by means of a pressure difference between these is reduced, the amount of reduction in the delivery fuel pressure is made smaller, and the fuel valve 10 is allowed to open more easily. The above approach allows the fuel valve 10 to open more easily at an engine rotational speed that is lower than the standard valve-opening timing, and the required fuel in the range of high-speed rotation in particular can be accurately supplied.

For a fuel system in which the fuel flow rate tends to become greater than a standard predetermined flow rate, the insertion depth in the valve hole 37 of the valve element 35 is reduced, the fuel escape quantity that flows through the escape channel 27 is increased, the amount of reduction in the delivery fuel pressure is increased, and the fuel valve 10 is rendered more difficult to open. With the above approach, the fuel valve 10 is rendered resistant to opening until the rotational speed of the engine is higher than the standard valve-opening timing, the fuel flow rate delivered to the suction channel 2 is reduced, and the drawback whereby the air-fuel mixture in a range of high speed rotation is made excessively rich is overcome.

The control valve 29 is capable of steplessly having its degree of opening adjusted by manual operation, so any deviation of the fuel flow rate can be corrected in accordance with the variations of individual fuel systems for carburetors, and the fuel flow rate can also be easily controlled with high precision in carburetors for general-purpose engines that handle small quantities of fuel.

At this point, when the throttle valve 29 is opened a certain degree of opening or greater, the throttle 28 in the escape channel 27 does not allow the fuel escape quantity to increase above this degree of opening. By limiting the quantity to a level below the fuel throughflow when the control valve 29 is completely open, it is possible to prevent the air-fuel mixture from being made overly thin and the exhaust condition and engine operational performance from being adversely affected even if the fuel flow rate delivered to the constant fuel chamber 5 is reduced when the control valve 29 is mistakenly opened completely. The throttle 28 is not limited to the downstream side from the control valve 29 of the escape channel 27, but may also be disposed in the upstream side.

The attachment hole 38 for mounting the control valve 29 was formed inside the main body 1, but it may be formed on the exterior of the main body 1, on the pump cover 17, or in another location, depending on the arrangement of the suction channel 20 and the delivery channel 23, or the location of the fuel pump 15.

According to the present invention, the channel surface area of the escape channel for allowing a portion of the delivery fuel to escape to the low pressure region of suction side can be steplessly adjusted by a manual control valve so that the delivery fuel pressure from the fuel pump exerted on the fuel valve that controls the introduction of fuel to the constant fuel chamber does not increase beyond a specified pressure, wherein variability in the fuel flow rate to the suction channel caused by variation in the constituent parts of the carburetor can easily be corrected with high precision, a predetermined flow rate of fuel can be accurately supplied to the engine, and excellent exhaust conditions and operability can be achieved, as described above.

What is claimed is:

1. A pulse-type diaphragm fuel pump for a carburetor, comprising a pulse chamber and a pump chamber facing each other across a diaphragm, a suction channel having a suction valve, for introducing fuel from a fuel tank into the pump chamber, a delivery channel having a delivery valve for guiding fuel pressurized in the pump chamber to a constant fuel chamber in the carburetor; wherein the exit side of the delivery valve of the delivery channel and the entrance side of the suction valve of the suction channel are connected by an escape channel for allowing a portion of the delivery fuel to escape to the suction side, and a manual control valve for steplessly adjusting the channel surface area of the escape channel.

2. The pulse-type diaphragm fuel pump for a carburetor according to claim 1, further comprising a throttle provided in the escape channel for limiting the fuel escape quantity to an amount less than the maximum throughflow of the control valve.

3. The pulse-type diaphragm fuel pump for a carburetor according to claim 1, wherein the control valve has a needle-shaped valve element protruding at the leading end of a screw shaft coupled to the base end of a head body with a tool hole and a valve hole formed in the escape channel, wherein the control valve steplessly adjusts the channel surface area of the escape channel by inserting or removing the valve element from the valve hole.

4. The pulse-type diaphragm fuel pump for a carburetor according to claim 2, wherein the control valve has a needle-shaped valve element protruding at the leading end of a screw shaft coupled to the base end of a head body with a tool hole and a valve hole formed in the escape channel, wherein the control valve steplessly adjusts the channel surface area of the escape channel by inserting or removing the valve element from the valve hole.

5. The pulse-type diaphragm fuel pump for a carburetor according to claim 3, wherein an annular piece is fitted and fixed in the base end opening portion of the attachment hole in which the screw shaft is threadably inserted, and wherein the annular piece allows the insertion of a tool, but does not allow the head body to pass.

* * * * *